US005225847A

United States Patent [19]

Roberts et al.

[11] Patent Number: 5,225,847

[45] Date of Patent: Jul. 6, 1993

[54] AUTOMATIC ANTENNA TUNING SYSTEM

[75] Inventors: David A. Roberts, Finksburg; Brian T. DeWitt, Silver Spring, both of Md.

[73] Assignee: Antenna Research Associates, Inc., Beltsville, Md.

[21] Appl. No.: 652,397

[22] Filed: Feb. 7, 1991

Related U.S. Application Data

[63] Continuation of Ser. No. 298,130, Jan. 18, 1989, abandoned.

[51] Int. Cl.[5] ..... H01Q 9/00

[52] U.S. Cl. ..... 343/745; 343/861; 455/123; 333/17.3

[58] Field of Search ..... 343/745, 861, 744, 855, 343/850, 748; 333/17 M; 455/123

[56] References Cited

U.S. PATENT DOCUMENTS

| | | | |
|---|---|---|---|
| 3,381,222 | 4/1968 | Gray | 333/17.3 |
| 3,475,703 | 10/1969 | Kennedy et al. | 343/745 |
| 3,550,137 | 12/1970 | Kuecken | 343/744 |
| 3,588,905 | 6/1971 | Dunlavy, Jr. | 343/856 |
| 3,778,731 | 12/1973 | Oomen | 333/173 |
| 4,234,960 | 11/1980 | Spilsbury et al. | 455/123 |
| 4,343,001 | 8/1982 | Anderson et al. | 343/745 |
| 4,356,458 | 10/1982 | Armitage | 333/17.3 |
| 4,380,767 | 4/1988 | Goldstein et al. | 343/745 |
| 4,493,112 | 1/1985 | Bruene | 343/861 |
| 4,965,607 | 10/1990 | Wilkins et al. | 343/860 |

FOREIGN PATENT DOCUMENTS

| | | | |
|---|---|---|---|
| 8808645 | 11/1988 | World Int. Prop. O. | 455/123 |

*Primary Examiner*—Rolf Hille
*Assistant Examiner*—Hoanganh Le
*Attorney, Agent, or Firm*—Lane, Aitken & McCann

[57] ABSTRACT

In an automatic tuning system for an antenna having a single variable reactance element, the power transmitted to the antenna and the power reflected from the antenna on the feedline are sensed. The variable reactance component of the antenna is adjusted until the ratio between the transmitted and reflected power on the feedline indicates that the standing wave ratio on the feedline is at a minimum, whereupon the antenna will be tuned. The adjustment of the variable reactance component is by a stepping motor controlled by a microprocessor, which is programmed to make calculations to determine when the standing wave ratio reaches a minimum.

10 Claims, 3 Drawing Sheets

13
28
POT
RMS OF RECEIVER AUDIO
RECEIVER AGC
FORWARD POWER DETECTOR
21
REFLECTED POWER DETECTOR
23
ADDRESS LINES
MULTIPLEXER
47
EXTERNAL CONNECTOR
46
FREQUENCY COUNTER
45
ANALOG TO DIGITAL CONVERTER
39
RAM
37
EPROM
35
NULL DETECTION CIRCUIT
49
MICRO-PROCESSOR
31
48
DIGITAL TO ANALOG CONVERTER
41
VOLTAGE TO FREQUENCY CONVERTER
51
STEPPING MOTOR
27
STEPPING MOTOR DRIVE UNIT
43
DATA BUS
33

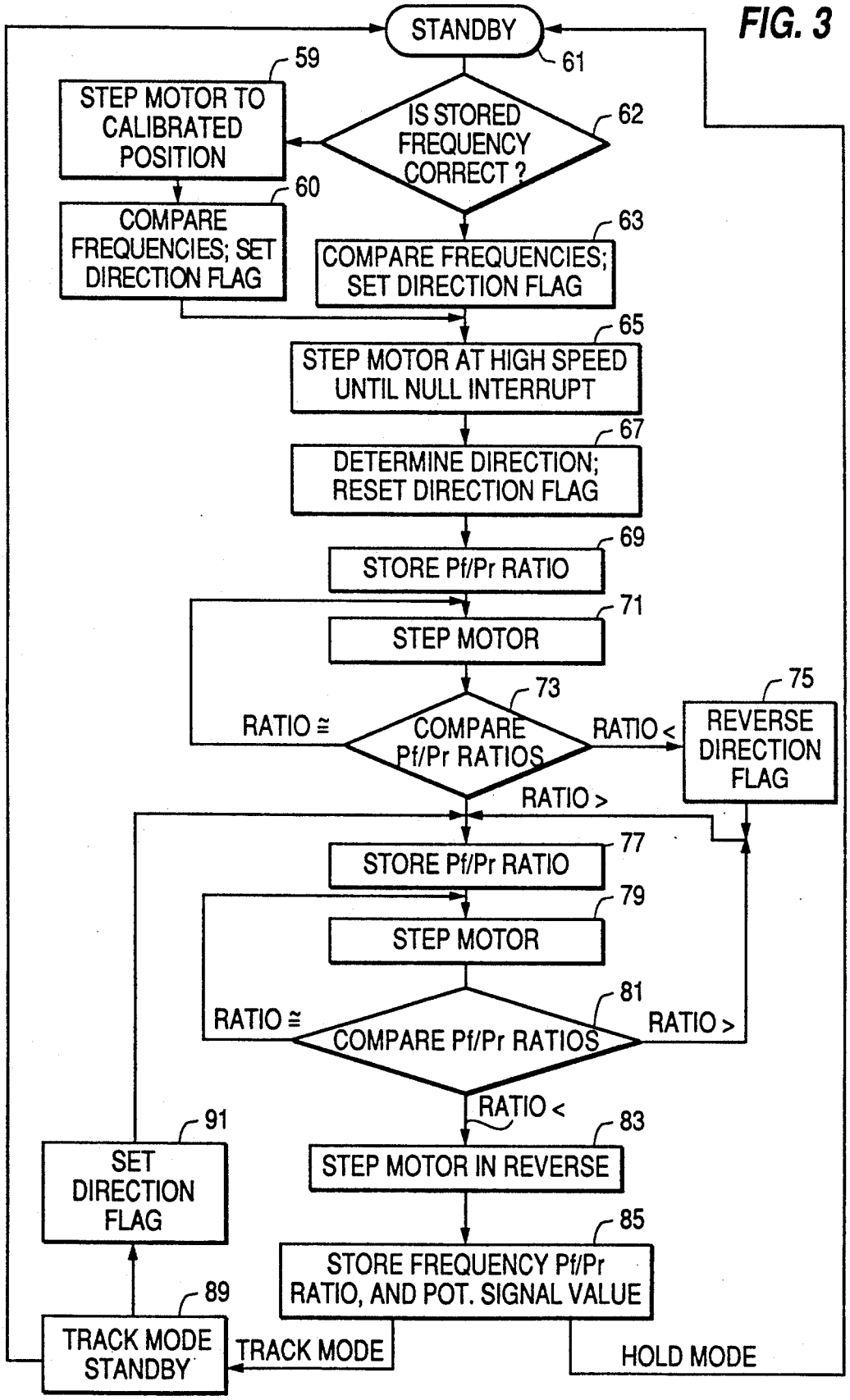
FIG. 3
STANDBY
61
IS STORED FREQUENCY CORRECT ?
62
STEP MOTOR TO CALIBRATED POSITION
59
COMPARE FREQUENCIES; SET DIRECTION FLAG
60
COMPARE FREQUENCIES; SET DIRECTION FLAG
63
STEP MOTOR AT HIGH SPEED UNTIL NULL INTERRUPT
65
DETERMINE DIRECTION; RESET DIRECTION FLAG
67
STORE Pf/Pr RATIO
69
STEP MOTOR
71
COMPARE Pf/Pr RATIOS
73
RATIO ≅
RATIO <
REVERSE DIRECTION FLAG
75
RATIO >
STORE Pf/Pr RATIO
77
STEP MOTOR
79
COMPARE Pf/Pr RATIOS
81
RATIO ≅
RATIO >
RATIO <
STEP MOTOR IN REVERSE
83
STORE FREQUENCY Pf/Pr RATIO, AND POT. SIGNAL VALUE
85
HOLD MODE
SET DIRECTION FLAG
91
TRACK MODE STANDBY
89
TRACK MODE

AUTOMATIC ANTENNA TUNING SYSTEM

This application is a continuation of U.S. patent application Ser. No. 07/298,130, filed Jan. 18, 1989, now abandoned.

This invention relates to a system for automatically tuning antennas and more particularly to a system for automatically tuning a transmitting antenna to the frequency being transmitted using only one variable reactive circuit element.

In transmitting antennas which have a narrow tuned bandwidth, it is important to tune the antenna to the transmitted frequency in order to achieve optimum performance in which maximum power is radiated. Prior to the present invention, systems for automatically tuning transmitting antennas were known. In some of these systems, the antenna is automatically tuned to the transmitted frequency by using a phase discriminator. The phase discriminator compares the phase of the current to the voltage in the feedline or compares the phase of the current in the feedline at the driving point with the phase of the current in the main conductor of the antenna. The tuning of the antenna is then adjusted by the antenna tuning element depending on the sign of the phase difference until the two signals are in phase. These automatic tuning systems of the prior art often fail to achieve precise tuning because of the practical difficulties inherent in sampling the phases of two reference signals over a wide frequency range, resulting in an impedance mismatch between the antenna and the transmitter. Such an impedance mismatch may cause a reduction in power transmitted and reduce the efficiency of the transmitter/antenna combination. In addition, some of the prior art automatic tuning systems required that the phase discriminator circuitry be located at or near the antenna which required the circuitry to be exposed to environmental conditions.

SUMMARY OF THE PRESENT INVENTION

The present invention avoids the problems of the systems of the prior art by using a different technique to detect when the antenna is tuned, and that is by tuning the antenna for the best impedance match of the antenna to the feedline, or in other words, to the minimum standing wave ratio. This is done by sensing the transmitted power and the reflected power and using the ratio of these power levels to indicate when the minimum standing wave ratio has been achieved. When the standing wave ratio is at is lowest value, the antenna is tuned. This system of tuning the antenna is particularly effective with a loop antenna of the type disclosed in U.S. Pat. No. 3,588,905, invented by John H. Dunlavy. The system may also be used with the antenna disclosed in U.S. Pat. No. 3,550,137, invented by John A. Kuecken, or an equivalent half loop antenna. As described in the Dunlavy patent, the antenna comprises a large loop driven by a smaller loop within the large transmitting loop. Antennas of the type disclosed in the Dunlavy patent have the characteristic that the impedance of the antenna has a nearly constant value when the antenna is tuned to resonate at the frequency being transmitted. This feature facilitates automatic tuning by means of the system of the present invention.

In accordance with the invention, the power transmitted to the antenna is detected, the power reflected from the antenna is detected, and these power values are fed to a microprocessor control unit, which compares the two values and then drives a stepping motor connected to the tuning capacitor for the antenna in accordance with the detected values. Initially, the stepping motor is stepped at a rapid rate until a null detector circuit indicates that the tuning of the antenna reaches a value near the tuned value, whereupon the stepping motor is stepped at a slower rate until the ratio between forward and reflected power indicates that the antenna is in tune with the transmitted frequency.

With the system as described above, tuning of the capacitor is achieved more consistently and more accurately because the difficulties inherent in sampling the phases of two reference signals over a wide frequency range are avoided. While both the forward and the reflected power readings may be frequency dependent, they both have similar frequency dependence, and this frequency dependency tends to be canceled in the ratio between the forward power and the reflected power. As a result, automatic precise tuning of the antenna over a wide frequency range is achieved with consistency. In addition, no circuitry is required at the antenna where it would be subject to environmental conditions because the forward and reflected power levels can be monitored anywhere along the feedline.

An object of the tuning procedure is to tune the antenna in a minimum amount of time. The null detector circuit is used because the microprocessor cannot read the forward and reflected power and then calculate the ratio between forward and reflected power fast enough. The null detector circuit, which uses high speed operational amplifiers, is much faster than the microprocessor method with existing state of the art microprocessor, analog-to-digital converters, and operational amplifiers.

Further advantages and objects of the present invention will become readily apparent from the following detailed description of the invention when taken in conjunction with the drawings.

BRIEF DESCRIPTION OF THE DRAWINGS

FIG. 3 is a flowchart illustrating a computer program employed by a microprocessor employed in the microcomputer control unit illustrated in FIG. 2.

DESCRIPTION OF PREFERRED EMBODIMENTS

Figure 1:
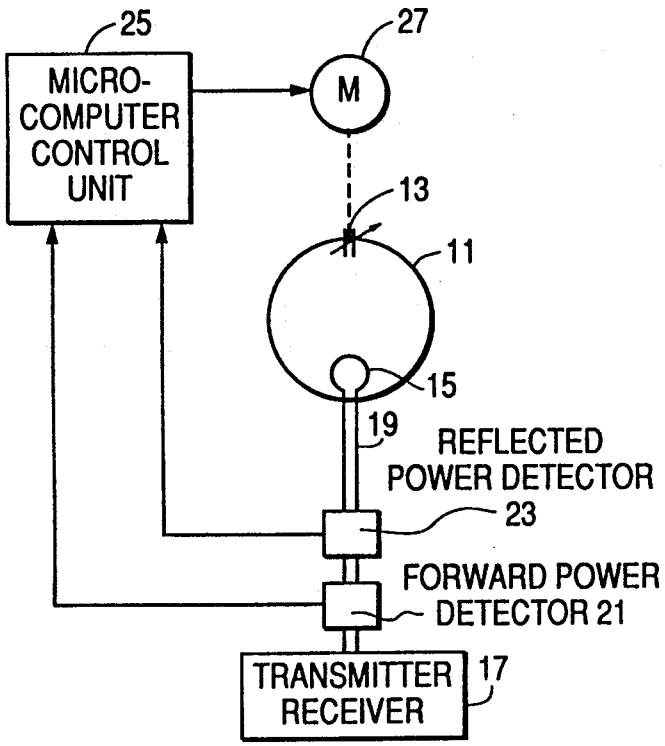
FIG. 1 schematically illustrates the automatic tuning system of the present invention.

In the system as shown in FIG. 1, a loop antenna 11 tuned by a capacitor 13 is driven by a feedloop 15. The details and the operation of this antenna are disclosed in U.S. Pat. No. 3,588,905 to Dunlavy. The feedloop 15 is connected to a transmitter-receiver 17 by a feedline 19. The feedline 19 passes through forward and reflected power detectors 21 and 23 comprising directional couplers set in opposite directions with means to convert the amplitudes of the RF signals from the directional couplers to DC analog signal voltages. The forward power detector 21 generates an analog voltage signal proportional to the power transmitted by the transmitter receiver 17 on the feedline 19 to the feedloop 15 and applies this signal to a microcomputer control unit 25. The amount of power reflected from the feedloop 15 back along the feedline 19 is detected by the reflected power detector 23, which applies an analog signal voltage proportional to the reflected power to the microcomputer control unit 25.

When the microcomputer control unit 25 detects that the transmitter 17 is operating in a transmitting mode and is transmitting the signal to the feedloop 15 to be radiated by the antenna 11, the microcomputer control unit 25 will automatically drive a stepping motor 27 which is connected to the variable tuning capacitor 13 to tune the antenna 11 to the transmitted frequency. This automatic tuning is done by comparing the transmitted frequency with the previous frequency to which the antenna was tuned to first determine the direction in which to step the motor and then stepping the motor in this direction until the standing wave ratio reaches a minimum value, whereupon the antenna will be tuned.

The standing wave ratio, SWR, is related to the ratio of reflected power Pr to the forward power $P_f$ in accordance with the following formula:

$$SWR = \frac{1 + P_r/P_f}{1 - P_r/P_f}$$

When the ratio of reflected power to transmitted power $P_r/P_f$ is at a minimum, the standing wave ratio will be at a minimum. It is also true, therefore, that when the ratio of forward power to reflected power, $P_f/P_r$, is at a maximum, the standing wave ratio will be at a minimum. Thus the ratio between the reflected and the forward power is an indicator of the minimum standing wave ratio. The system of the present invention determines when the standing wave ratio is at a minimum by detecting when the ratio $P_f/P_r$, reaches a maximum.

The microcomputer precisely determines the maximum ratio $P_f/P_r$, using the output signals of the detectors 21 and 23 and adjusts the capacitance of the capacitor 13 to the value at which this maximum occurs by stepping the capacitance of the capacitor 13 until the ratio $P_fP_r$ stops increasing and begins to decrease. At this point the control unit 25 steps the motor back to position the capacitor 13 at the maximum $P_fP_r$ and at which the antenna 11 will be tuned to the transmitted frequency.

Figure 2:
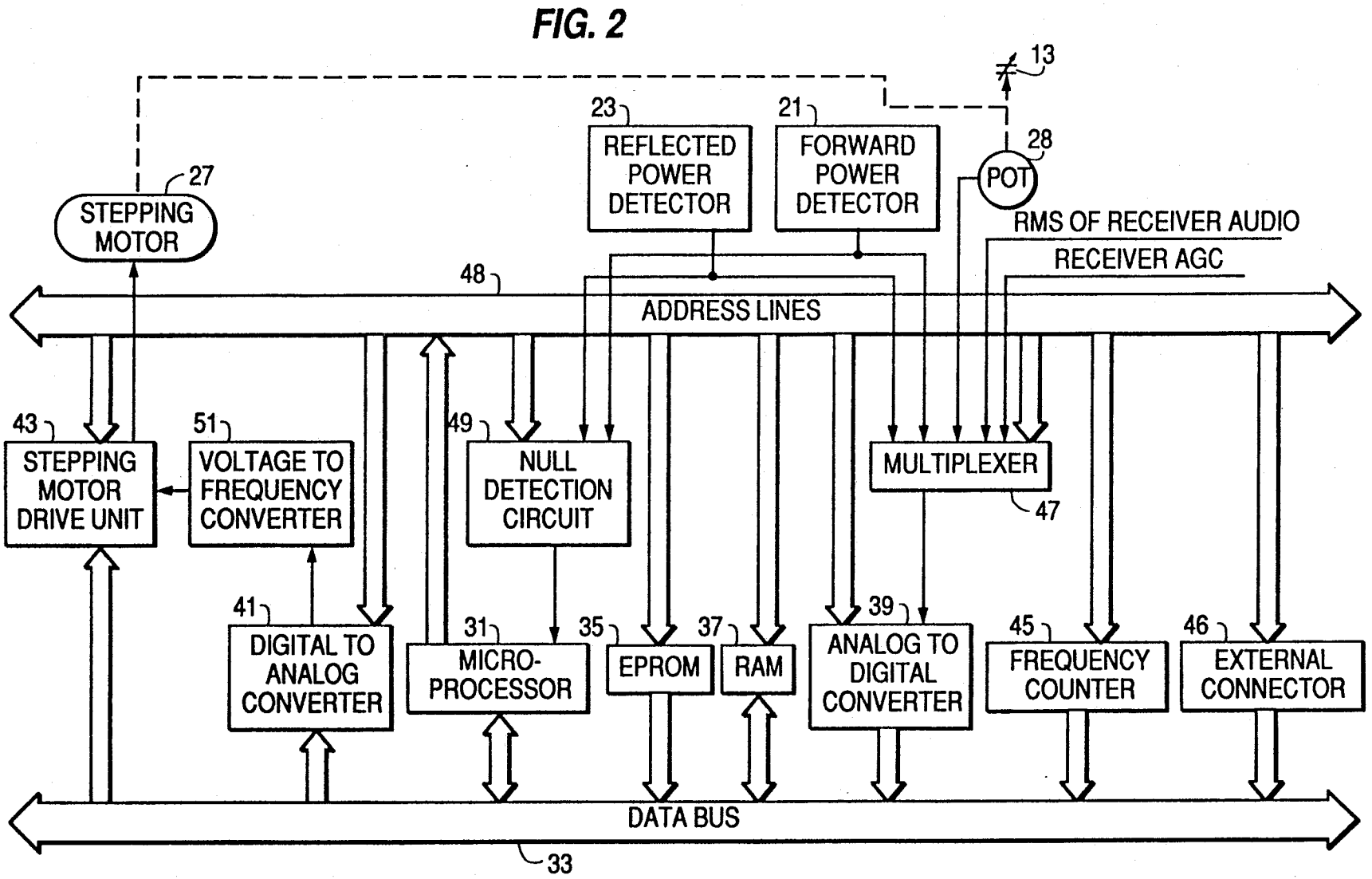
FIG. 2 is a block diagram of the microcomputer control unit employed in the system of FIG. 1.

The details of the microcomputer control unit are shown in FIG. 2. As shown in FIG. 2, the microcomputer control unit comprises a microprocessor 31 which is connected by an eight bit data bus 33 to an EPROM 35, which is a read only memory, a random access memory 37, an analog-to-digital converter 39, a digital-to-analog converter 41, a stepping motor drive unit 43, a frequency counter 45, and an external connector 46. The microprocessor 31 can receive eight bit data words from the EPROM 35 over the bus 33 and the microprocessor 31 operates under a program received from the EPROM 35. The microprocessor can store eight bit data words in and receive eight bit data words from the memory 37 over the data bus 33. In addition, the microprocessor can receive eight bit data words from the analog-to-digital converter 39, the frequency counter 45, and the external connector 46, and transmit eight bit data words to the digital-to-analog converter 41 and to the motor drive unit 43. The analog-to-digital converter 39 receives an analog signal from a multiplexor 47, which is connected to receive the analog output signals from the forward and reflected power detectors 21 and 23 and a potentiometer 28 geared to the tuning capacitor 13. The potentiometer 28 applies a signal to the multiplexer varying with the position of the adjustable tuning mechanism of the capacitor 13 and accordingly with the tuning of the antenna. The multiplexer 47 also has an input for receiving the automatic gain control signal of the receiver circuit in the transmitter-receiver 17 and an input to receive a signal representing the RMS value of the audio signal generated by the receiver circuit. The microprocessor 31 is connected by address lines 48 to the EPROM 35, the memory 37, the analog to digital converter 39, the digital-to-analog converter 41, the motor drive unit 43, the frequency counter 45, and the external connector 46, and by the signals applied to these address lines under the control of the program received from the EPROM 35, controls which of the units it receives data from or transmits data to in accordance with the program instruction currently being carried out. When the microprocessor has completed a program instruction received from the EPROM over the data bus, the microprocessor obtains the next instruction of the program from the EPROM by signals applied to the EPROM over the address lines. The address lines are also connected to the multiplexer 47 and control which of the analog signals applied to the multiplexer 47 are selected by the multiplexer 47 and applied to the analog-to-digital converter 39. The output signals from the forward power detector 21 and the reflected power detector 23 are also applied to null detection circuit 49, which detects when the ratio between the reflected power and the transmitted power has reached a pre-set value. When enabled by address signals applied by the microprocessor 31, the null detector 49 will apply an interrupt signal to the microprocessor 31 in response to the ratio reaching this pre-set value. The frequency counter 45 receives the signal transmitted or received on the feedline 19 and generates an output digital signal representing this frequency, which output digital signal will be transmitted over the bus 33 to the microprocessor when the frequency counter 45 is selected by the address signals applied on the address lines 48 to the frequency counter 45.

The digital-to-analog converter 41, when selected by address signals from the microprocessor unit 31, will apply an analog signal voltage proportional to the applied digital value received on the databus from the microprocessor to a voltage-to-frequency converter 51. In response to the applied analog signal, the voltage-to-frequency converter will apply a frequency signal to the motor drive unit 43. The motor drive unit 43 is connected to the input windings of the stepping motor 27, which drives the tuning capacitor 13 in the loop antenna 11. The motor drive unit 43 can step the motor at a high stepping rate corresponding to the frequency applied to the motor drive circuit from the voltage-to-frequency converter 51 in either direction or it can step the motor forward or reverse one step at a time in response to the data applied to the motor drive circuit 43 over the data bus 33 from the microprocessor unit 31. The operation of the motor drive unit 43 to step the motor 27 at a high speed in accordance with the frequency signal received from the voltage-to-frequency converter 51 or to step the motor one step forward or back in accordance with the applied data received over the bus 33 is controlled by the address signals applied to the motor drive unit 43 over the address lines 48 from the microprocessor 31. When the address signals applied to the motor drive circuit indicate that the motor drive circuit should step the motor at a high speed in accordance with the frequency signal from the voltage-to-frequency converter, the address signals will also indicate the direction that the motor is to be stepped. The direction in which the stepping motor is to be stepped is controlled by the sequence of energization and deenergization of its windings. When the address signals from the microprocessor indicate that the stepping motor is to be stepped at a high speed, a stepping motor drive circuit in the stepping motor drive unit 43 will apply pulses to the stepping motor windings in the sequence to step the motor in the direction indicated by the address signals at the frequency received from the voltage-to-frequency converter 51. When the stepping motor is stepped one step at a time, data signals applied to the stepping motor drive unit 43 over the data bus 33 from the microprocessor will indicate which windings of the stepping motor are to be energized or deenergized to advance the motor one step in the desired direction. In response to the received data signals and in response to being selected by the address signals on address lines 48, the motor drive unit 43 will energize or deenergize the winding indicated by the data signals and thus advance the motor one step.

The flow chart shown in FIG. 3 illustrates the program carried out by the microprocessor to automatically tune the antenna to the transmitted frequency. Before radio transmission on the antenna begins, the program will be in standby routine 61, in which the program remains until the power transmitted in the forward direction along the feedline rises above a minimum value indicating that transmission is taking place and until the frequency of the signal on the feedline has changed by a predetermined amount from the previously tuned frequency of the antenna, which will be stored in the memory 37. At the end of each tuning operation, both the frequency to which the antenna has been tuned and .the position of the potentiometer are stored at selected addresses in the memory 37. In the standby routine, the program periodically compares the current frequency with the previously tuned frequency stored in memory 37 and senses the power transmitted on the feedline. If these values exceed the minima, the program advances out of the standby routine 61 into decision sequence 62 to begin the automatic tuning operation. The microprocessor senses the power transmitted on the feedline by addressing the multiplexor 47 to select the output from the detector 21 and then reading the value of the output of the analog-to-digital converter 39.

In decision sequence 62, the program determines whether or not there is a valid previously tuned frequency value stored in the memory 37. If the previous tuned value stored in memory 37 represents a valid frequency value for the antenna operating range, the program advances into instruction sequence 63, in which the frequency on the feedline as indicated by the frequency counter is compared with the previous tuned frequency stored in the memory 37. This comparison provides an indication of which way the stepping motor should be stepped in order to move the capacitor toward the position to tune the antenna to the frequency currently being transmitted on the feedline. In response to the comparison of the two frequency values, the microprocessor sets a stepping direction flag in the random access memory 37 to indicate the direction in which the motor is to be stepped to move the capacitor 13 toward the tuned position. The program then advances into routine 65 to begin the high speed driving of the stepping motor toward the tuned position of the capacitor 13.

If in decision sequence 62, the program determines that no valid previous tuned frequency is stored in the memory 57, as would be the case for example, when the antenna is tuned for the first time or if the tuning frequency stored in memory 37 became erased, the program will branch into instruction sequence 59, in which the stepping motor is stepped to the nearest position at which the tuned frequency of the antenna is known. The antenna tuning is calibrated at specific predetermined positions, such as the upper limit, the lower limit and the midpoint against the output signal of the potentiometer 28. In instruction sequence 59, the program steps the motor until the output signal of the potentiometer 59 equals that of the calibrated position. This stepping is done at a high speed by applying appropriate data signals to the digital-to-analog converter 41 and appropriate address signals to the digital-to-analog converter 41 and the stepping motor drive unit 43. In this routine 59, the output signal of the potentiometer is repeatedly read and compared with the known signal value at the calibrated position toward which the motor is being stepped. As the signal value produced by the potentiometer 28 approaches that at the calibrated position, the digital value applied to the digital-to-analog converter 41 is reduced to slow the motor down. The motor is stopped when the output value of the potentiometer 28 equals the value for the potentiometer value at the calibrated position. Following this routine, in instruction sequence 60, the program compares the frequency being transmitted with the frequency at the known calibrated position to which the motor was stepped in routine 59 and sets the stepping direction flag in memory 37 in accordance with this comparison. The program then enters routine 65 to commence the high speed stepping of the motor toward the desired tuned position.

In instruction sequence 65, the program again steps the motor at a high speed in a manner similar to that described with respect to instruction sequence 60. In both instruction sequences 60 and 65, in order to properly accelerate the stepping motor to the high stepping speed, the microprocessor initially applies a sequence of increasing digital values to the digital-to-analog converter 41 to accelerate the motor relatively gradually to its maximum stepping speed. This technique of accelerating the stepping motor is employed because the stepping motor would not respond to high frequency stepping pulses corresponding to the maximum stepping speed when it is at rest. The stepping motor must be accelerated gradually to the maximum speed.

While the stepping motor is being driven at a high speed in instruction sequence 65, the microprocessor will enable the null detection circuit 49 to apply its interrupt signal to the microprocessor 31. The program waits in the routine 65 until the null interrupt signal is received by the microprocessor from the null detection circuit, whereupon the program advances into instruction sequence 67. When the null detection circuit 49 detects that the ratio between the forward power and the reflected power has reached the threshold value set in the null detection circuit, the capacitor will be nearing the tuned position. At this time the null detection circuit applies the null interrupt signal to the microprocessor to cause it to advance into instruction sequence 67. In this instruction sequence, the microprocessor applies address signals to the motor drive circuit to cause it to stop the stepping of the motor in accordance with the applied frequency signal from the voltage-to-frequency converter whereupon the tuning mechanism of the capacitor 13 will stop at a position which will be near the tuned position of the capacitor. Normally, the tuning mechanism will have been driven past the tuned position so that the motor must be stepped in the reverse direction to move to the tuned position. However, in a few positions, which will have been determined experimentally, the tuning mechanism will normally stop short of the tuned position. A table representing ranges of values containing the latter tuned positions, are stored in the random access memory 37 and in instruction sequence 67, the microprocessor compares the output signal of the potentiometer 48 with the stored value ranges. If the output signal of the potentiometer 48 is not within one of the stored value ranges, the microprocessor in instruction sequence 67 reverses the stepping direction flag stored in the random access memory. If the output signal of the potentiometer 67 indicates that the tuning capacitor is in a position in which the tuning mechanism normally stops short of the tuned position, the microprocessor leaves the stepping direction flag in its current state in instruction sequence 67.

Following instruction sequence 67, the program advances into instruction sequence 69 in which the ratio of the forward power to reflected power, $P_f/P_r$, is computed and stored in the memory 37. This ratio is computed by reading the output values of the forward power and reflected power detectors from the multiplexer, then calculating the ratio, and storing this value in the memory 37. The program then advances into instruction sequence 71 in which the microprocessor sends a signal to the motor drive circuit to cause the stepping motor to step one step in the direction indicated by the stepping direction flag stored in the random access memory. Following instruction sequence 71, the program advances into decision sequence 73, in which program determines whether the current ratio, $P_f/P_r$, is less than, greater than, or about the same as the previously measured ratio stored in the random access memory 37 in instruction sequence 69. If the current ratio is substantially less, this means that the direction determined in instruction sequence 67 and the first step of the stepping motor caused in instruction sequence 71 was in the wrong direction. Accordingly, the program branches into instruction sequence 75 in which the stepping direction flag is reversed and then the program enters instruction sequence 77. If the current ratio, $P_f/P_r$, as determined in decision sequence 73 is significantly greater than the stored value of the ratio, this means that the stepping direction determined in the instruction sequence 67 was correct and the motor was stepped in the correct direction in instruction sequence 71. Upon determining that the ratio is significantly greater, the program advances into instruction sequence 77. An insubstantial change in the ratio is disregarded as noise. Accordingly, if the ratio has not changed by a predetermined minimum amount in decision sequence 73, the program returns to instruction sequence 71 to repeat the steps of sequences 71 and 73.

In the instruction sequence 77, the program replaces the stored value of the ratio, $P_f/P_r$, in the memory 37 with the current value of the ratio and then advances into instruction sequence 79 wherein the stepping motor is stepped one step in the direction indicated by the direction flag. From instruction sequence 79, the program enters decision sequence 81, in which the program again determines whether the current ratio, $P_f/P_r$, is greater than, less than, or about the same as the stored value. If the current ratio is greater than the stored ratio, this means that the capacitor has not reached its tuned position and the program branches back to instruction sequence 77 to reiterate sequences 77, 79 and 81. If the current ratio is about the same as the stored value, the program returns to instruction sequence 79 to reiterate sequences 79 and 81. When in instruction sequence 81, the motor has been stepped past the tuned position, the microprocessor will determine that the current ratio, $P_f/P_r$, is less than the stored value and from decision sequence 81, the program will advance into instruction sequence 83. In instruction sequence 83, the program steps the motor back in the reverse direction from that indicated by the direction flag, to bring the motor back to the tuned position. Following instruction sequence 83, the program carries out instruction sequence 85 in which the current value of the frequency being transmitted is stored in the memory as the value of the previous frequency to be employed in the next iteration through the program of FIG. 3. At this point, the process of automatically tuning the antenna to the frequency being transmitted on the feedline has been completed.

In the automatic tuning process, the program may be controlled by a switch on the front panel of the automatic tuning system to be in a hold mode or a tracking mode. In the hold mode, once the automatic tuning process through instruction sequence 85 has been completed, the capacitor will be held in its tuned position and will not be retuned until the transmitted frequency changes by a predetermined amount, whereupon the program of FIG. 3 will be repeated. In the tracking mode, the system is designed to automatically retune the antenna as the resonant frequency of the antenna drifts due to heating.

If the system is operating in a hold mode, then from instruction sequence 85, the program returns to standby routine 61. If the system is operating in a tracking mode, then after a completion of instruction sequence 85, the program advances into the tracking mode standby routine 89, in which the program periodically compares the ratio, $P_f/P_r$, with the stored value. When the current ratio has changed by a predetermined value indicating that the tuned frequency has drifted from the precisely tuned value, the program advances into instruction sequence 91, in which the program sets the stepping direction flag in accordance with whether or not the current frequency is above or below the stored value of the frequency. From instruction sequence 91, the program returns to instruction sequence 77 and operates to step the motor one step at a time until the antenna is again precisely tuned. If in standby routine 89, transmissions on the feed line to the antenna ceases, the program returns to standby routine 61.

The microprocessor is also provided with a program to automatically tune the antenna to the received frequency when the transmitter-receiver is operating in a receiving mode. When the receiver is operating in a receiving mode, the microprocessor control unit will receive data indicating the frequency to which the receiver circuit is tuned over the external connector 46 and then will automatically tune the antenna to this frequency by a program similar to that illustrated in FIG. 3. However, in this mode of operation, instead of using the forward and reflected power to determine when the antenna is tuned, the precise tuning of the antenna is determined by when the automatic gain control signal reaches a maximum value or, in the alternative, when the RMS signal derived from the audio output from the receiver reaches a maximum value. Also, instead of a null circuit to provide an interrupt to the microprocessor to indicate when the microprocessor should switch from high speed stepping, the microprocessor instead continuously monitors the automatic gain control signal or the RMS signal from the audio output of the receiver and determines when it has risen above a preset threshold value.

Figure 4:
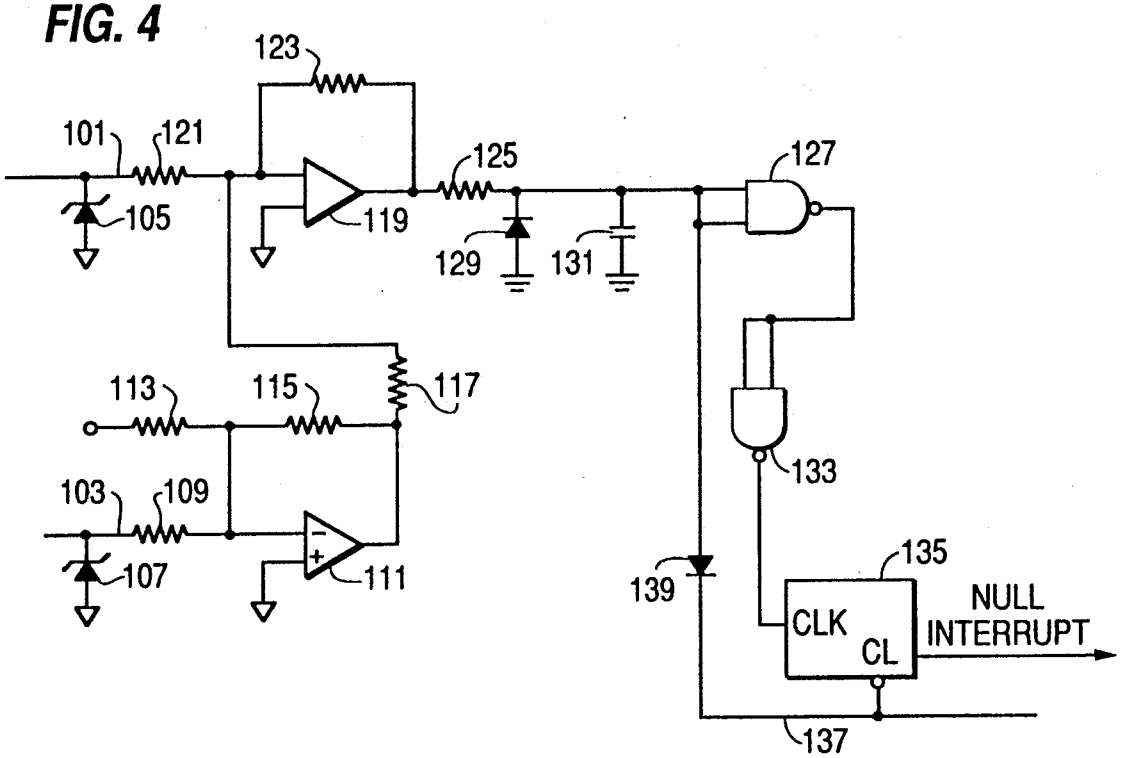
FIG. 4 is a circuit diagram of a null detecting circuit employed in the system of FIG. 1.

The null detection circuit 49, as shown in FIG. 4, has an input channel 101 for receiving an input signal from the reflected power detector 23 corresponding to the level of reflected power on the feedline 19 and an input channel 103 for receiving a signal from the forward power detector 21 corresponding to the forward power transmitted on the feedline 19. The input channels 101 and 103 are connected to a circuit common through the zener diodes 105 and 107, respectively, which serve as power surge protectors.

The reflected power is received from a 250 watt element whereas the forward power is received from a 1,000 watt element to cause attenuation of the forward power signal relative to the reflected power signal. As a result, the forward power signal on channel 103 is attenuated by a factor of four relative to the reflected power signal on channel 101. The signal representing forward power is applied through a 100 kilohm resistor 109 to the inverting input of an operational amplifier 111. The positive input of the operational amplifier 111 is connected to the circuit common. A five volt DC supply voltage is connected through a 10 megohm resistor 113 to the inverting input of the operational amplifier 111. The output of the operational amplifier 111 is connected to the inverting input thereof through a 2.7 megohm resistor 115. The output of the operational amplifier 111 is connected through a 3.3 megohm resistor to the inverting input of an operational amplifier 119 which is also connected to the input channel 101 through a 100 kilohm resistor 121. The positive input of the operational amplifier 119 is connected to circuit common. The output of the operational amplifier 119 is connected through a 3.3 megohm resistor to the inverting input of the operational amplifier 119. With this arrangement, the signals representing the forward and reflected power are subtracted from each other at the output of the amplifier 119, with the amplitude of the signal representing reflected power having been increased by a factor of about 5 relative to the amplitude of the signal representing forward power. The output of the operational amplifier 119 is connected through a 1 kilohm resistor 125 to the input of a trigger circuit 127. The input of the trigger circuit 127 is also connected to ground through a diode 129 and a 0.1 microfarad capacitor 131. The output of the trigger circuit 127 is connected to the input of a trigger circuit 133, the output of which is connected to the clock input of a flipflop 135. The flipflop 135 has a signal line 137 connected to its clear input and this signal line is connected to receive the null enable signal from the microprocessor 31. The signal line 137 is also connected through a diode 139 to the input of the trigger circuit 127.

The operation of the null detecting circuit will now be described. As the antenna approaches the tuned position, the reflected power on the feedline 19 will drop. When the reflected power has dropped to a level of about one-fifth of the forward power on the signal line, the output of the amplifier 119 will change to positive and will exceed the 1.6 volt threshold for the trigger circuit 127. As a result, the trigger circuit 127 will switch states and change its output from a high level to a low level, thus switching the state of the trigger circuit 133, which will switch its output applied to the clock input of the flipflop 135 from a low level to a high level. The signal applied to the flipflop 135 on line 137 from the microprocessor will be a high level signal when the null detector circuit is to be enabled to apply its interrupt signal to the microprocessor and is a low level signal when the null detection circuit is to be disabled so that it cannot apply a null interrupt signal to the microprocessor. Whenever a low level signal is applied to the flipflop 135 on the signal line 137, the flipflop 135 will be cleared and will be held in this cleared state so that it cannot be set or switched to its set state by the output of the trigger circuit 133 and thus cannot apply the null interrupt signal to the microprocessor. Whenever a high level signal or null enable signal is applied on input line 137 to the flipflop 135, and the output signal from trigger circuit 133 switches from its low level state to its high level state, the flipflop 135 will be switched to its set state, and will apply the null interrupt signal to the microprocessor. Thus, when the ratio of forward power to reflected power increases above a preset value equal to about 5, the trigger circuit 127 will be triggered to produce a low level output, which in turn will trigger the trigger circuit 133 to produce a high level output. If at this time the flipflop 135 is receiving an enable signal on line 137 from the microprocessor, the flipflop 135 will apply the null interrupt signal to the microprocessor.

When the microprocessor applies a clear signal or a low level signal to the input signal line 137, this low level signal will also be applied through the diode 139 to the input of the trigger circuit 127 to ensure that the trigger circuit 127 is switched to its untriggered state when the flipflop 135 is cleared and is conditioned to switch to its triggered state the next time its input signal voltage rises above the 1.6 volt threshold level for the trigger circuit.

The system of the invention described above, by employing the standing wave ratio indicator to determine when the antenna is tuned, achieves automatic tuning with accuracy and consistency. Since the forward and reflected power used by the system of the invention to achieve tuning may be detected anywhere along the antenna feedline, the system requires no circuitry at the antenna, which might be adversely affected by environmental conditions. The above description is of a preferred embodiment of the invention and modification may be made thereto without departing from the spirit and scope of the invention, which is defined in the appended claims.

We claim:

1. An automatic tuned antenna system comprising an antenna having a variable reactance component, a feedline connected to said antenna to apply to a signal to said antenna to be transmitted thereby and causing a signal to be reflected from said antenna on said feedline, and means connected by an electrical connection to said feedline and by a mechanical connection to said reactive component responsive to power levels on said feedline to repeatedly adjust said variable reactance component in incremental steps in a direction to tune said antenna and to stop the adjustment when the standing wave ratio on said feedline is at a minimum, said means responsive to power levels on said feedline comprising means to sense the power level of the signal transmitted to said antenna over said feedline and means to sense the power level of the signal reflected from said antenna on said feedline, said means responsive to the power levels on said feedline comprising ratio determining means to determine a ratio between the power level transmitted to said antenna on said feedline and the power level of the signal reflected from said antenna on said feedline and to adjust said reactive component until variation of said ratio changes direction, said ratio determining means determining said ratio after each incremental step and adjusting said reactance component another incremental step after each incremental step only if the variation in said ratio did not change direction after such incremental step.

2. An automatically tuned antenna system as recited in claim 1, wherein said means to determine ratio determines the ratio of the transmitted power to the reflected power and adjusts the variable reactance component until the ratio of the transmitted power to the reflected power reaches a maximum.

3. An automatically tuned antenna system as recited in claim 1, wherein said means responsive to power levels comprises a microprocessor programmed to determine when the standing wave ratio on said feedline is at a minimum.

4. An automatically tuned antenna system as recited in claim 1, wherein said antenna comprises a closed loop with said variable reactance comprising a capacitance connected in series with said closed loop.

5. An automatically tuned antenna system comprising an antenna having a variable reactance component, a feedline connected to said antenna to apply a signal to said antenna to be transmitted thereby and causing a signal to be reflected from said antenna on said feedline, and means connected by electrical connection to said feedline and by mechanical connection to said reactive component responsive to power levels on said feedline to repeatedly adjust said variable reactance component in a direction to tune said antenna and to stop the adjustment when the standing wave ratio on said feedline is at a minimum, said means responsive to power levels on said feedline comprising a stepping motor connected to said variable reactance component to adjust the reactance of said variable reactance component, and stepping motor control means to step said motor at a relatively high stepping rate until the reactance of said variable reactance component has been adjusted to a value near where said standing wave ratio is at a minimum, said stepping motor control means, after stepping said motor at said relatively high stepping rate, stepping said motor one step at a time at a rate lower than said high stepping rate, and after each step, determining the value of a quantity which varies with the minimum standing wave ratio, until said quantity indicates that the standing wave ratio is at the minimum attainable by stepping the stepping motor, said stepping control means comprising a microprocessor which determines the value of said quantity, said stepping motor control means comprising a voltage-to-frequency converter, said relatively high stepping rate corresponding to the output frequency of said voltage-to-frequency converter, and means responsive to digital signals received from said microprocessor to apply a voltage to said voltage-to-frequency converter to control the output frequency of said voltage-to-frequency converter.

6. An automatically tuned antenna system as recited in claim 5, wherein said stepping motor control means steps said motor at said relatively high rate until a ratio between the power of the signal transmitted on said feedline to said antenna and the power of the signal reflected from said antenna on said feedline reaches a predetermined value and thereafter steps said motor one step at a time and determines said quantity after each step.

7. An automatically tuned antenna system as recited in claim 5, wherein said quantity is a ratio between the power of the signal transmitted on said feedline to said antenna and the power of the signal reflected from said antenna on said feedline.

8. A method of automatically tuning an antenna having a variable reactance component and a feedline connected to said antenna to apply a signal to said antenna to be transmitted thereby and causing a signal to be reflected form said antenna on said feedline comprising the steps of measuring the level of power transmitted to said antenna on said feedline, measuring the level of power reflected from said antenna on said feedline, determining the ratio between said reflected power and said transmitted power on said feedline, automatically repeatedly changing said component by an incremental amount in the direction to tune said antenna, and stopping the repeated changes when said ratio reaches a maximum or minimum.

9. A method as recited in claim 8, wherein the step of automatically repeatedly changing said reactance component changes said reactance component in increments at a first rate until the reactance of said reactance component has been adjusted to a value near that at which said antenna is tuned and thereafter changes said reactance component one step at a time at a rate lower than said first rate and after each step, determining the value of said ratio until said ratio reaches said maximum or said minimum.

10. A method as recited in claim 8, further comprising changing said reactance in increments until the change in the magnitude of said ratio reverses direction and thereafter changing said reactance component one increment in the reverse direction from the direction in which said reactance component had been changed in the previous steps.

* * * * *